US006104899A

United States Patent [19]

Hokari et al.

[11] Patent Number: 6,104,899

[45] Date of Patent: Aug. 15, 2000

[54] IMAGE FORMING APPARATUS CAPABLE OF REDUCING THE SKEW OF AN IMAGE FORMED ON A SHEET

[75] Inventors: Norio Hokari; Takashi Kawabata; Keiji Yamamoto; Naoto Yoshino; Naoto Nishi; Nobuyoshi Komatsu; Tatsuya Soga; Shuji Iseki; Yukio Hayashi, all of Ebina, Japan

[73] Assignee: Fuji Xerox Co., Ltd., Tokyo, Japan

[21] Appl. No.: 09/383,970

[22] Filed: Aug. 27, 1999

[30] Foreign Application Priority Data

Aug. 28, 1998 [JP] Japan ..... 10-243573

[51] Int. Cl.[7] ..... G03G 15/00; G03G 15/16

[52] U.S. Cl. ..... 399/165; 399/308; 399/395

[58] Field of Search ..... 399/16, 162, 163, 399/165, 299, 301, 302, 303, 308, 390, 394, 395, 313; 198/806

[56] References Cited

U.S. PATENT DOCUMENTS 4,429,985 2/1984 Yokota ..... 399/165
5,394,222 2/1995 Genovese ..... 399/165 X
5,481,338 1/1996 Todome ..... 198/806 X
5,659,851 8/1997 Moe et al. ..... 399/165

FOREIGN PATENT DOCUMENTS 5-018449 1/1993 Japan .
9-110229 4/1997 Japan .

*Primary Examiner*—Sophia S. Chen
*Attorney, Agent, or Firm*—Oliff & Berridge, PLC

[57] ABSTRACT

In an image forming apparatus adapted to transfer a toner image formed on a photosensitive drum to an intermediate transfer belt, and thereafter to a sheet, the position of one end portion of a backup roll around which the intermediate transfer belt is passed is set regulatable, this end portion being fixed after the position thereof has been regulated. The position of one end portion of a driving roll, cleaning blades or photosensitive drum may be set regulatable. This arrangement enables the skew of an image formed on a sheet to be reduced.

4 Claims, 15 Drawing Sheets

IMAGE FORMING APPARATUS CAPABLE OF REDUCING THE SKEW OF AN IMAGE FORMED ON A SHEET

BACKGROUND OF THE INVENTION

1. Field of the Invention

This invention relates to an image forming apparatus provided with an endless belt for transferring a sheet to an image forming means, or an endless belt on a surface of which an image to be transferred to a sheet is formed.

2. Description of the Related Art

As shown in FIGS. 1(A) and 1(B), an image forming apparatus adapted to fix a sheet 13 on a surface of an endless belt 12 passed around rolls 10, 11, and transfer toner images formed on photosensitive drums 14–17 onto the sheet 13 has already been known. In this image forming apparatus, the toner images are transferred successively from a plurality of photosensitive drums 14–17 onto the sheet 13 in accordance with a movement of the endless belt 12. Consequently, a multi-color toner image 18 is obtained on the sheet 13.

As shown in FIGS. 2(A) and 2(B), an image forming apparatus adapted to transfer a toner image 19 from a photosensitive drum 20 to a surface of an endless belt 12 as an intermediate transfer member, and then transfer this toner image 19 again to a sheet 13 has already been known as well. In this image forming apparatus, the endless belt 12 passes through a nip provided between a backup roll 21 and a bias transfer roll (not shown), and the sheet 13 also passes the same. During the passage of the endless belt and sheet through the nip, the toner image 19 on the endless belt 12 is transferred to the sheet 13 owing to an electric field generated by the bias transfer roll.

In these image forming apparatuses, the belt does not always move at right angles to the rolls 10, 11 due to manufacturing errors of the endless belt support rolls, errors of parallelism of the rolls, manufacturing errors of the belt, and a difference between the tension applied to the belt at one end portion of each roll and that applied to the belt at the other end portion thereof. Namely, the endless belt 12 moves in a twisted manner in the shape of the numeral "8" in plan in some cases as shown in the drawings. Consequently, the image transferred from the photosensitive drum is distorted.

For example, even when a rectangular image is tried to be formed in the apparatus of FIGS. 1(A) and 1(B), a rhomboidal image is transferred to the sheet 13 on the endless belt 12. Therefore, even when a skew of a lead edge LE of the resultant toner image 18 is small, that of a side edge SE is large as shown in FIG. 1(C).

Even when a rectangular image is tried to be formed in the apparatus of FIGS. 2(A) and 2(B), a rhomboidal image is transferred to the endless belt 12. In the condition shown in FIG. 2(A) in which the transferring of a toner image has just been done, a skew of a side edge only of the toner image 19 is large. However, after the toner image 19 has been turned around the roll 11, a lead edge thereof is also skewed. As a result, both the skew of the lead edge LE and that of the side edge SE are large as shown in FIG. 2(C) in the toner image 19 formed on the sheet 13.

In recent years, the improvement of the quality of images has been demanded even in an image forming apparatus utilizing electrophotographic system, such as a copier, and a permissible range with respect to such a skew of image has been severely limited. Therefore, developing the techniques for preventing such an inclined movement of a belt as mentioned above have been demanded.

The techniques for controlling a lateral movement of an endless belt include, for example, those disclosed in Japanese Patent Laid-Open No.110229/1997. However, even when a lateral movement of the endless belt is controlled properly, an inclined movement thereof with respect to the rolls cannot be prevented. It is also possible that the belt in a steady moving condition moves as it is left distorted with respect to the rolls 10,11 as shown in FIGS. 1(A), FIG. 1(B), FIG. 2(A) and FIG. 2(B). Therefore, the conventional techniques do not satisfactorily reduce the inclination of the image formed on a sheet.

SUMMARY OF THE INVENTION

The present invention has been developed with these facts taken into consideration, and aims at providing an image forming apparatus capable of reducing the skew of an image formed on a sheet.

The image forming apparatus according to the present invention has multiple rotatable rolls, an endless belt passed around these rolls and adapted to be moved therearound, a means for forming an image on the endless belt or a sheet placed thereon, a contacting member which has two end portions the position of at least one of which is regulatable, and which is adapted to contact the endless belt in the widthwise direction thereof, and a means for fixing the end portion the position of which has been regulated of the contacting member.

According to this image forming apparatus, the position of at least one of both end portions of the contacting member contacting the endless belt in the widthwise direction thereof can be regulated. The direction of movement of the endless belt is regulated by thus regulating the position of an end portion of the contacting member. Accordingly, at least one of the skews of the lead edge and side edges of an image can be regulated and reduced. The condition of a sheet thus regulated is maintained by fixing the contacting member by the fixing means.

The contacting member may be any one of the rotatable rolls around which the endless belt is wound, or cleaning blades contacting the endless belt, or a combination thereof.

In this image forming apparatus, a means capable of regulating the direction of an image to be formed on the endless belt by the image forming means may be provided, by regulating the same image forming means.

The image forming apparatus according to the present invention may have multiple rotatable rolls, an endless belt passed around the rolls and adapted to be moved therearound, a means for forming an image on the endless belt or a sheet placed thereon, and a means capable of regulating the direction of the image to be formed on the endless belt by the image forming means, by regulating the same image forming means.

According to this image forming apparatus, the direction in which an image to be formed on the endless belt by the image forming means can be regulated by regulating the same image forming means by utilizing the direction regulating means. Accordingly, at least one of the skew of the lead edge and the skew of side edges of the image can be regulated and reduced.

This regulating means can comprise, for example, a means for tilting the photosensitive drum as an image forming means, a means for tilting a latent image writing unit with respect to the photosensitive drum, and a means for inclining an image, which the latent image writing unit writes on the photosensitive drum, by subjecting image writing data, to which the latent image writing unit refers when the latent image is written on the drum, to arithmetic processing.

DESCRIPTION OF THE PREFERRED EMBODIMENTS

Various modes of embodiment of the present invention will now be described with reference to the drawings.

First mode of embodiment

1. First mode of embodiment 1-1 Construction of a first mode of embodiment

Figure 3:
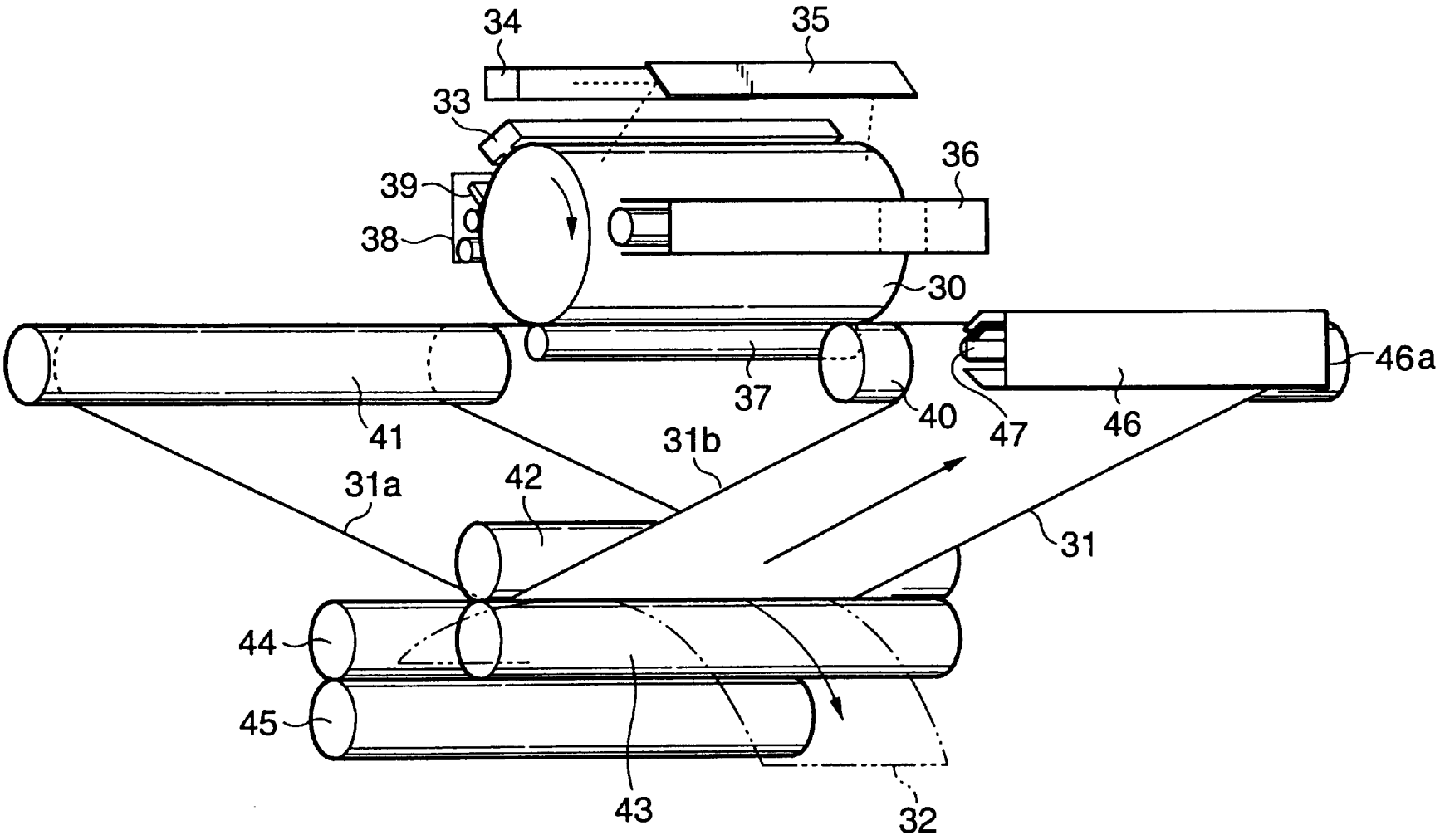
FIG. 3 is a perspective view showing a general construction of a first mode of embodiment of the image forming apparatus according to the present invention.

FIG. 3 shows a principal portion of an image forming apparatus (copier) utilizing an electrophotographic system to which the present invention is applied. As shown in the drawing, this image forming apparatus is of the type in which a single-color toner image formed on an outer surface of a columnar photosensitive drum 30 is once transferred to an intermediate transfer belt 31, the toner image on which is further transferred to a sheet 32. Around the photosensitive drum 30, a charging corotron 33, a latent image writing unit (ROS: raster output scanner) 34, a mirror 35, a developing unit 36, a primary transfer roll 37 and a cleaner 38 are arranged. The photosensitive drum 30 is rotated in the direction of an arrow shown in the drawing. While the photosensitive drum 30 is rotated, the charging corotron 33 uniformly charges a surface thereof, and a laser beam emitted by the latent image writing unit 34 and reflected on the mirror 35 is applied to this charged surface. Consequently, a latent image is formed owing to a photoelectric effect. The developing unit 36 is adapted to supply charged toner onto the surface of the rotating photosensitive drum 30. Owing to this operation, the toner is adsorbed on a latent image portion, and a toner image is formed.

The toner image formed on the surface of the photosensitive drum 30 is transferred to the intermediate transfer belt 31 owing to an electric field generated by the primary transfer roll 37. After this transfer operation has been completed, the photosensitive drum 30 is cleaned by the cleaner 38. The cleaner 38 is provided with a cleaning blade 39 adapted to contact the whole of a widthwise portion of an image forming region of the photosensitive drum 30.

The intermediate transfer belt 31 is an endless belt, which is passed around a driving roll 40 and rotatable driven rolls 41, 42 extending substantially in parallel with the driving roll, and which is moved in accordance with the rotation of the driving roll 40. The primary transfer roll 37 is disposed on the inner side of this intermediate transfer belt 31. In the vicinity of the driven roll 42, a secondary transfer roll 43 substantially parallel thereto is rotatably disposed. The intermediate transfer belt 31 passes through a nip provided between the secondary transfer roll 43 and driven roll 42.

The sheet 32 is sent out from a cassette (not shown) and via a transfer path, and also passes through the nip provided between the secondary transfer roll 43 and driven roll 42. During the passage of the sheet through the nip, the toner image on the intermediate transfer belt 31 is transferred to the sheet 32 owing to the effect of an electric field generated by the secondary transfer roll 43. The driven roll 42 works as a backup roll with the secondary transfer roll 43, for preventing the separation of the sheet 32 and intermediate transfer belt 31 from each other.

Prior to the secondary transfer of the toner image, the direction in which the sheet 32 faces is set properly by registration rolls 44, 45, and the toner image is thereafter fixed to the surface of the intermediate transfer belt 31 by the effect of a fixing aid unit (not shown). After the completion of the secondary transfer operation, the intermediate transfer belt 31 is cleaned by the cleaner 46. The cleaner 46 is provided with cleaning blades 47 adapted to contact the whole of a widthwise portion of an image forming region of the intermediate transfer belt 31. The sheet 32 to which the toner image has been transferred is then introduced to a fixing unit, in which the toner image thereon is fixed thereby.

In the above arrangement, a single color toner image is formed on the intermediate transfer belt 31. The present invention is not limited to this toner image forming system, i.e., a system for transferring a plurality of toner images from a single or a plurality of photosensitive drums 30 to the intermediate transfer belt 31 while the intermediate transfer belt 31 makes a plurality of turns, to form a multi-color toner image on the intermediate transfer belt 31 owing to the accumulation of these transferred toner images, may also be employed.

Figure 4:
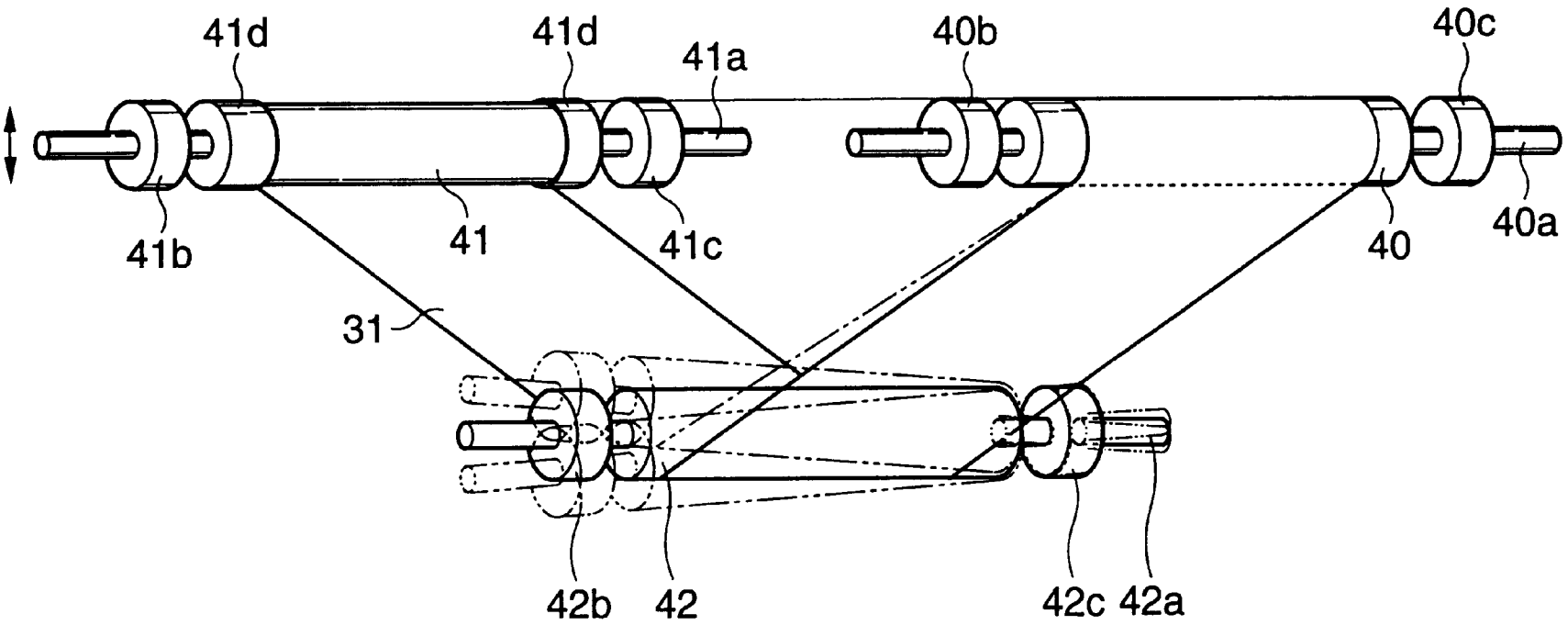
FIG. 4 is a drawing for describing the characteristics of the first mode of embodiment.

As shown in FIG. 4, the rolls 40–42 around which the intermediate belt 31 is passed is fixedly mounted on shafts 40*a,* 41*a,* 42*a* respectively. Both end portions of each of the shafts 40*a,* 41*a,* 42*a* are rotatably supported on bearings. Two bearings 40*b,* 40*c* supporting the driving roll 40 are fixed in predetermined positions.

One bearing 41*c* supporting the driven roll 41 is fixed in a predetermined position. On the other hand, the other bearing 41*b* is disposed so that it can be moved vertically by a mechanism (not shown), whereby the driven roll 41 can be moved pivotally around the bearing 41*c*. This mechanism is disclosed in Japanese Patent Laid-Open No. 110229/1997, which prevents the intermediate transfer belt 31 in motion from being moved laterally (axial direction of the driven roll 41) by not less than a predetermined distance. Concretely speaking, the driven roll 41 is provided on the portions thereof which correspond to both sides of the belt 31 with belt guides 41*d,* and sensors (not shown) for measuring loads imparted by the intermediate transfer belt 31 to the belt guides 41*d*. When a load measured with either one of the sensors (average load measured in a predetermined cycle, to be exact) is out of a predetermined range, the driven roll 41 is moved pivotally by moving the bearing 41*b* up or down so that the belt 31 is moved in the opposite direction.

The two bearings 42*b,* 42*c* supporting the backup roll 42 can be fixed in predetermined positions. One bearing 42*c* is disposed immovably, while the other 42*b* can be moved vertically prior to the use of and during the repairing of the image forming apparatus. Therefore, the backup roll 42 can be moved pivotally in a vertical plane around the bearing 42*c*. After the position of an end portion of the backup roll 42 has thus been regulated, the bearing 42*b* is fixed. In order that the regulating operation is carried out easily, the bearing 42*b* is preferably provided at the front side of the image forming apparatus.

Figure 5:
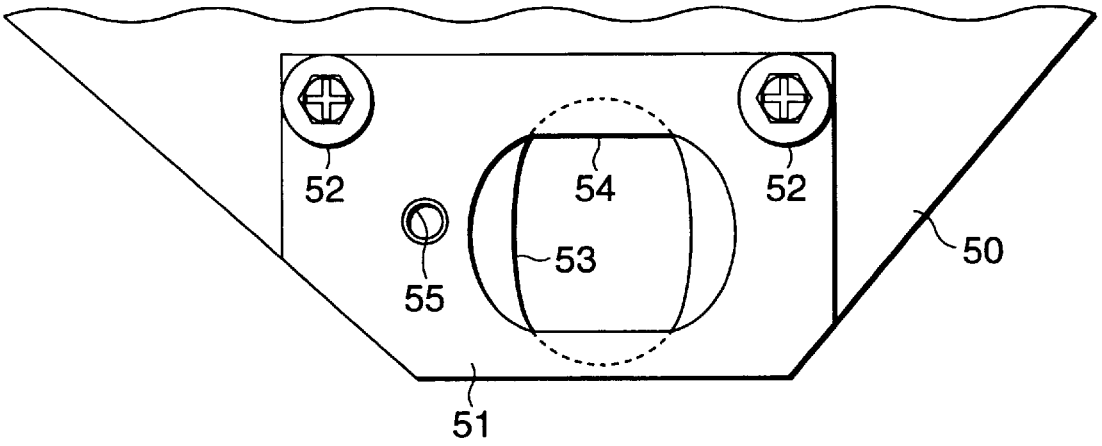
FIG. 5 is a front view showing a frame panel and a bracket for supporting a backup roll of the apparatus of the first mode of embodiment.

A structure thus enabling the regulation of the position of the bearing 42*b* will now be described with reference to FIGS. 5–9. Referring to these drawings, a reference numeral 50 denotes a frame panel on which the bearings 40*b,* 41*b,* 42*b* are supported. The frame panel 50 is disposed in a vertical plane parallel to the direction in which the intermediate transfer belt 31 moves. A flat plate type bracket 51 is fixed to the frame panel 50 by screws 52. As shown in FIG. 5, the frame panel 50 is provided with a vertically elongated through hole 53, and the bracket 51 is provided with a laterally elongated through hole 54. These elongated holes 53, 54 are substantially elliptic, and overlap each other so that the centers thereof are aligned with each other. The bracket 51 is also provided with a threaded hole 55.

Figure 6:
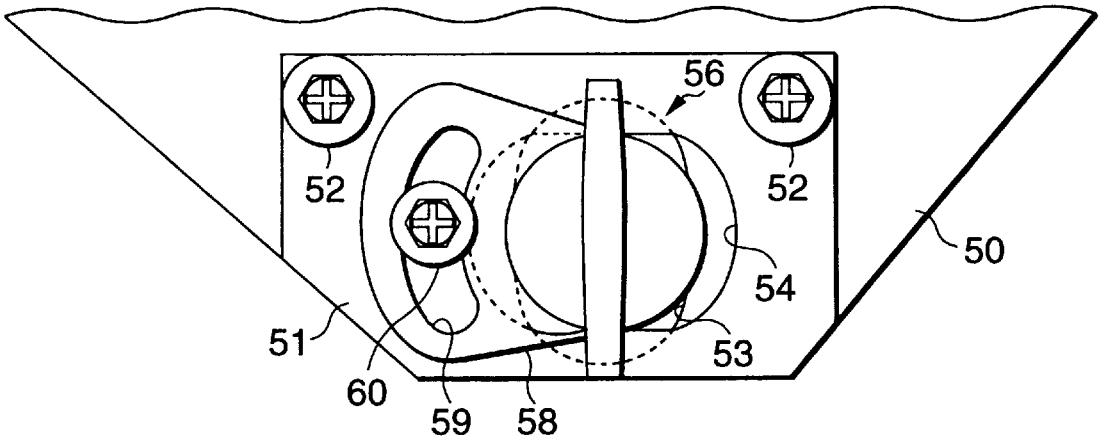
FIG. 6 is a front view showing a bearing holder fixed to the bracket.
Figure 7:
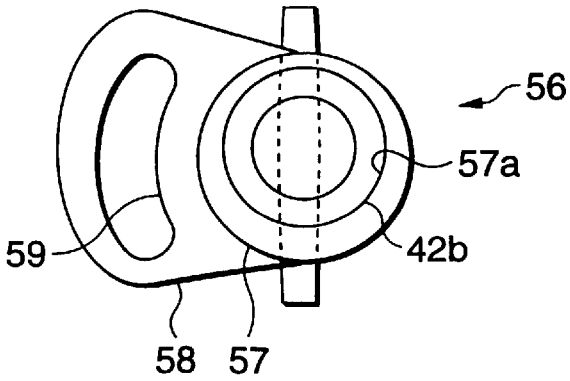
FIG. 7 is a rear view showing the bearing holder.
Figure 8:
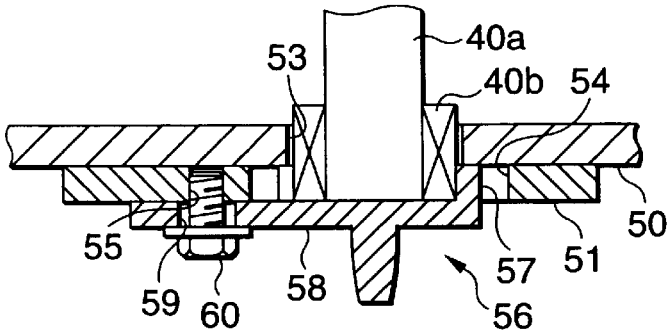
FIG. 8 is a sectional view showing the frame panel, bracket and bearing holder.

As shown in FIG. 6, a bearing holder 56 for retaining the bearing 42*b* is fitted in the elongated hole 54 of the bracket 51. As shown in FIGS. 7 and 8, the bearing holder 56 has a cylindrical portion 57 fitted in the elongated hole 54, and a fan-shaped projecting portion 58 extending from th cylindrical portion 57 in the sideward direction. The cylindrical portion 57 is provided with a circular retaining hole 57*a,* in which the bearing 42*b* having a circular contour is inserted. The retaining hole 57*a* is eccentric with respect to the cylindrical portion 57. Accordingly, the bearing 42*b,* which is held in the cylindrical portion 57, of the backup roll 42 and the shaft 42*a* are eccentric with respect to the cylindrical portion 57.

The projecting portion 58 is provided with an arcuate elongated through hole 59, in which a shank portion of a screw 60 is inserted. The shank portion of the screw 60 is engaged with the threaded hole 55. Accordingly, when the screw 60 is tightened, the projecting portion 58 is fixed. A shorter diameter of the elongated hole 54 of the bracket 51 is merely a little larger than the diameter of the cylindrical portion 57 of the bearing holder 56, and a shorter diameter of the elongated hole 53 of the frame panel 50 merely a little larger than an outer diameter of the bearing 42*b*. Therefore, when the bearing 42*b* is fixed at one point thereof by the screw 60, the position of the bearing 42*b* becomes stable.

Figure 9:
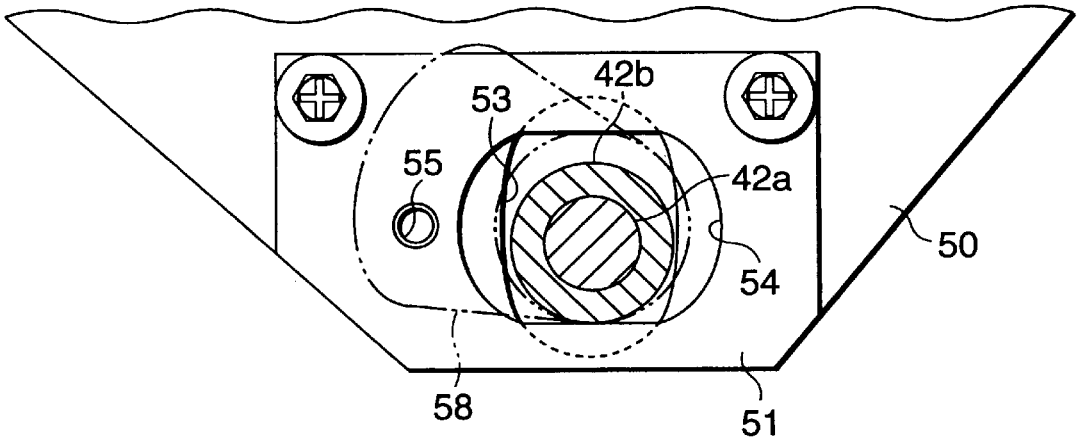
FIG. 9 is a front view showing a shaft of the backup roll which is supported on the bearing holder, frame panel and bracket.
Figure 10:
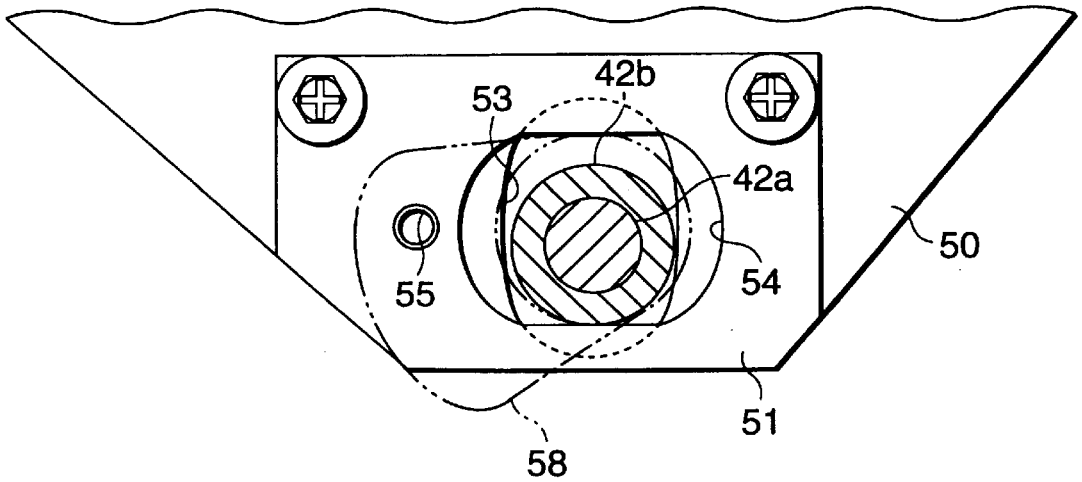
FIG. 10 is a front view showing the shaft of the backup roll which is supported on the bearing holder, frame panel and bracket.

In this structure, the cylindrical portion 57 of the bearing holder 56 and the bearing 42*b* are eccentric with respect to each other. Accordingly, the screw 60 is loosened with the bearing holder 56 turned as shown in FIGS. 9 and 10, the bearing holder 42*b* is moved vertically, and the backup roll 42 is swung in a vertical plane. When the screw 60 is tightened after the position of an end portion of the backup roll 42 has been regulated by thus swinging the backup roll 42, the bearing 42*b* is fixed.

A shaft of the secondary transfer roll 43 which holds the intermediate transfer belt 31 in cooperation with the backup roll 42 is rendered vertically displaceable by a spring. Therefore, the height of the secondary transfer roll 43 is changed in conformity with the swinging of the backup roll 42.

1-2. Regulation and effect of regulation of the backup roll in the first mode of embodiment As described above, when the screw 60 in this image forming apparatus is loosened, the backup roll 42 can be swung by turning the bearing holder 56. This enables the skew of an image formed on the sheet 32 to be reduced by regulating the position of an end portion of the backup roll 42. The effects of this operation will now be described.

As mentioned above, there can be a case where the belt moves incliningly with respect to the rolls due to manufacturing errors of the intermediate transfer belt-supporting rolls, an error of the parallelism of the rolls, manufacturing errors of the belt, and differences between the level of the tension given to one end portion of each roll and that of the tension given to the other end portion thereof. The problems concerning the matter in a conventional apparatus of this kind have been described with reference to the drawings 2(A)–2(C). Namely, it is possible that both a skew of a lead edge of an image formed and that of side edges thereof become noticeable with respect to the sheet.

Figure 11A:
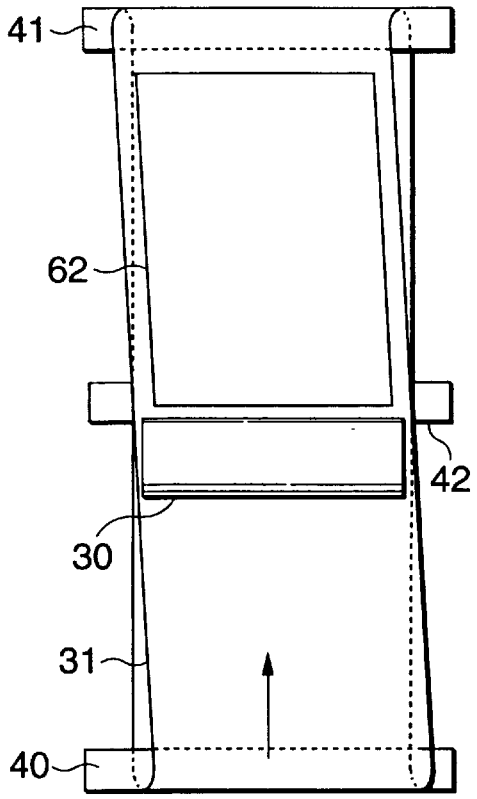
FIG. 11(A) is a plan view showing a belt in the first mode of embodiment and a toner image transferred to an upper surface thereof.
Figure 11B:
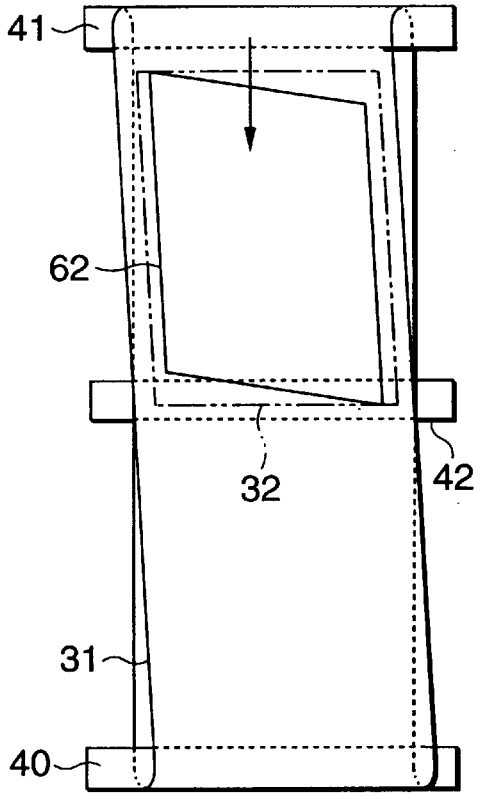
FIG. 11(B) is a bottom view of this image forming apparatus, showing a process for transferring the toner image, which has been transferred to the belt in this condition, to a sheet.
Figure 11C:
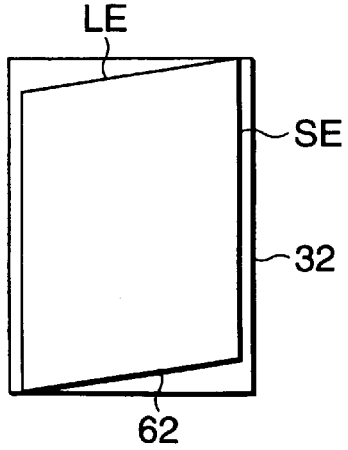
FIG. 11(C) is a plan view showing the image transferred to the sheet by this process.

However, even when an upper portion of the intermediate transfer belt 31 of the image forming apparatus of this mode of embodiment moves incliningly with respect to the rolls 40, 41 as shown in FIGS. 11(A) and 11(B), the direction in which a lower portion of the intermediate transfer belt 31 moves can be substantially aligned with that in which the sheet 32 moves, by swinging the backup roll 42. Although the skew of the side edges of a toner image 62 on the upper portion of the intermediate transfer belt 31 is large as shown in FIG. 11(A), these side edges are parallel to side ends of the intermediate transfer belt 31. Therefore, when the direction in which the lower portion of the intermediate transfer belt 31 moves substantially agree with that in which the sheet 32 moves, the skew of the side edges of the toner image 62 becomes minimum as shown in FIG. 11(B). As a result, the skew of the side edges SE of the toner image 62 formed on the sheet 32 is reduced as shown in FIG. 11(C).

As shown in FIG. 11(B), the lead edge is also skewed after the toner image 62 has passed around the roll 41. The mere regulation of the inclination of the backup roll 42 does not enable the skew of the lead edge LE to be eliminated. The elimination of the skew of the lead edge can be attained in fourth to sixth modes of embodiment which will be described later.

The regulation of the backup roll 42 can be carried out, for example, by repeating trials and errors. When the skew of side edges of an image practically formed on the sheet 32 is large, the screw 60 is loosened to regulate the height of the bearing 42*b*, and the screw 60 is then tightened to carry out the formation of an image, the skew of the side edges of the image formed on the sheet 32 being then examined. When the skew of the side edges has become minimum, the image forming apparatus is practically used. Such regulation can be made before the shipping of the image forming apparatus or after the apparatus has been subjected to repair work including the replacement of the intermediate transfer belt 31.

In this mode of embodiment, the bearing 42*b* of the backup roll 42 is rendered displaceable in the vertical direction, i.e., along a bisector of an angle made by two sides 31*a*, 31*b*, which extend with the backup roll 42 positioned therebetween, of the intermediate transfer belt 31. Accordingly, only a slight displacement of the bearing 42*b* enables the direction in which the lower portion of the intermediate transfer belt 31 moves to be changed, and this structure proves to be most efficient. However, the present invention does not intend to be limited to this structure. The bearing 42*b* may be rendered displaceable in other direction as long as such a structure is capable of changing the direction of movement of the lower portion of the intermediate belt 31.

Figure 12:
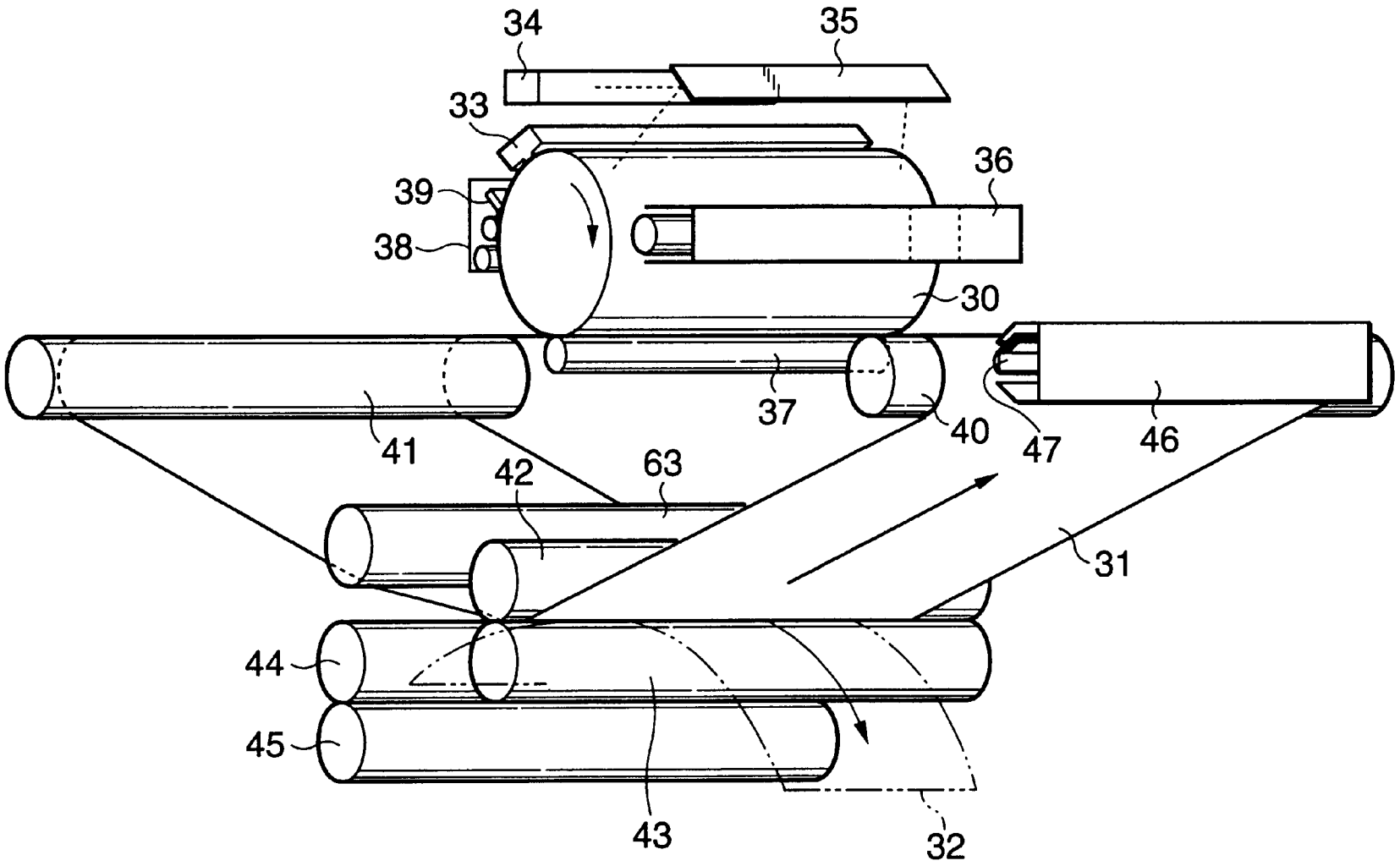
FIG. 12 is a perspective view showing a general construction of an image forming apparatus of a modified example of the first mode of embodiment of the present invention.

In this mode of embodiment, the direction of movement of the intermediate belt 31 is regulated by pivotally moving the backup roll 42 but the present invention does not intend to be limited to this method. The direction of movement of the intermediate belt 31 may also be regulated as in a structure shown as one modified example in FIG. 12, in which an additional roll (tension roll 63), by which the portion of an intermediate transfer belt 31 which contacts therewith is guided, is provided between a driven roll 41 and a backup roll 42 and regulated in the same manner as mentioned above.

2. Second mode of embodiment

Figure 13:
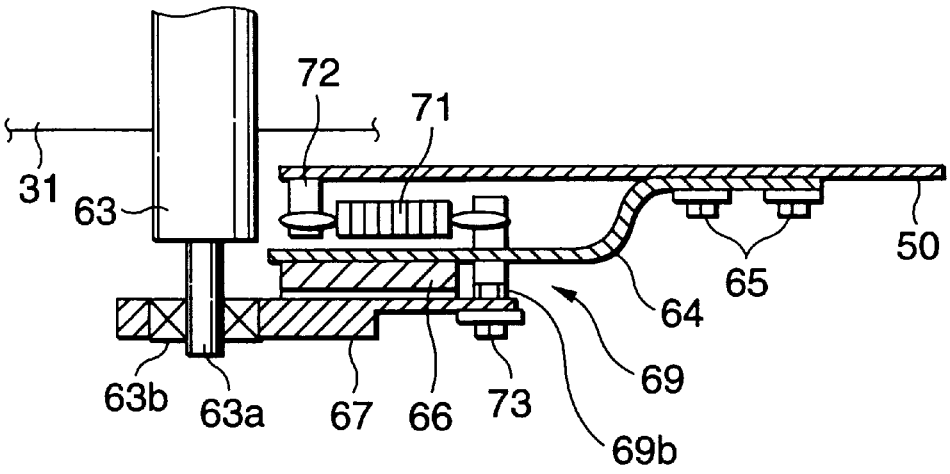
FIG. 13 is a sectional view showing a principal portion of a second mode of embodiment of the image forming apparatus according to the present invention.
Figure 14:
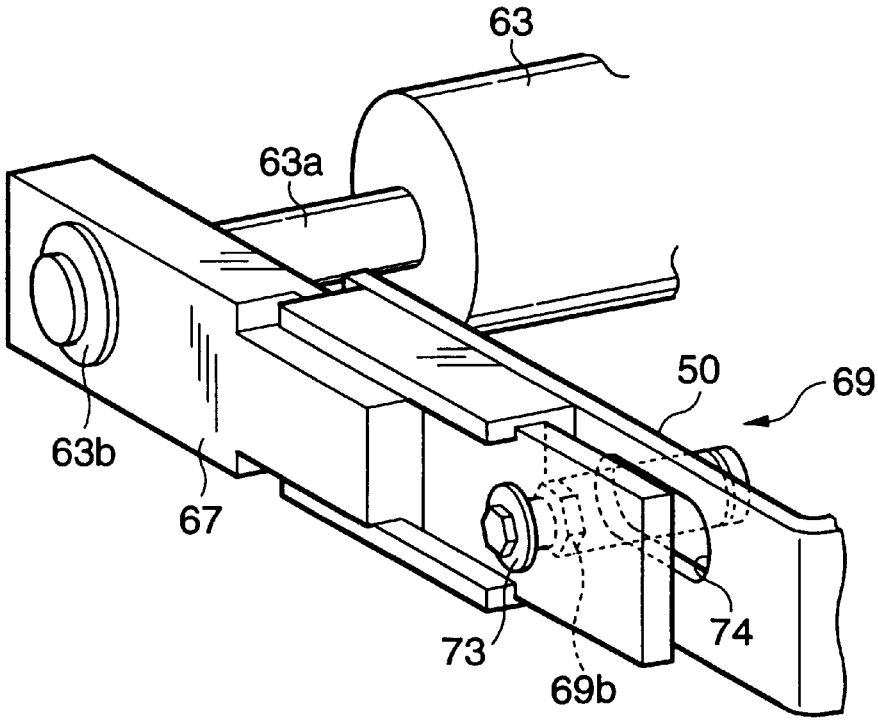
FIG. 14 is a perspective view showing the principal portion shown in FIG. 13.
Figure 15:
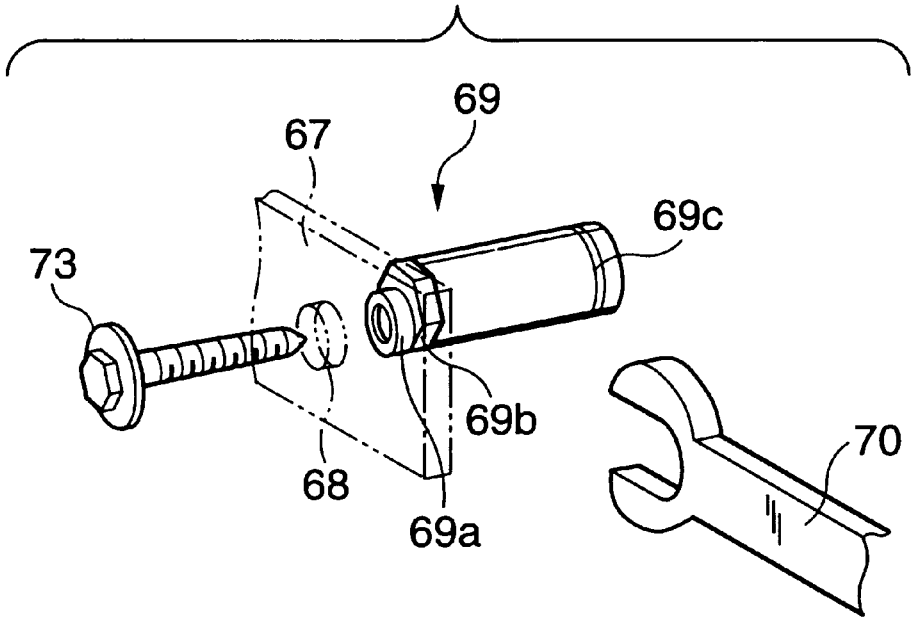
FIG. 15 is an exploded perspective view showing the principal portion shown in FIG. 13.

A second mode of embodiment of the present invention will now be described. The basic structure of the image forming apparatus of the second mode of embodiment is identical with that of the apparatus shown in FIG. 12. In this structure, a bearing supporting one end portion of the tension roll 63 is set movable, and the position of the bearing is fixed after it has been moved. FIGS. 13–15 show a concrete structure for regulating the position of such a bearing. As shown in FIG. 13, a second panel 64 is fixed to a frame panel 50 by screws 65.

As shown in FIGS. 13 and 14, a guide 66 is fixed to the second panel 64, and a bearing holder 67 is fixed slidably to the guide 66. A bearing 63*b* for retaining rotatably one end portion of a shaft 63*a* of a tension roll 63 rotatably is fixed in the bearing holder 67. Therefore, the bearing 63*b* is moved in accordance with a sliding movement of the bearing holder 67 to cause the tension roll 63 to be pivotally moved. A bearing (not shown) rotatably retaining the other end portion of the shaft 63*a* is fixed in a predetermined position.

The bearing holder 67 is provided with a through hole 68 as shown in FIG. 15. A columnar projecting portion 69*a* extending from one end of a cylinder 69 is inserted into the through hole 68. The projecting portion 69*a* is formed as a part of the cylinder 69, and is eccentric with respect to the other part thereof. The diameter of the projecting portion 69*a* is substantially equal to that of the through hole 68. A threaded hole is formed in an end surface of the projecting portion 69*a*, and a screw 73 is engaged with the threaded hole. The cylinder 69 is fixed to the bearing holder 67 by tightening the screw 73.

The cylinder 69 is also provided with a hexagonal bolt portion 69*b*. When a wrench 70 is fitted around this hexagonal bolt portion 69*b*, the cylinder 69 can be turned. The cylinder 69 is provided with a circumferential groove 69*c* in the other end portion thereof. A hook formed at one end portion of a coiled spring 71 is fitted in this circumferential groove 69*c*, and a hook formed at the other end portion of the coiled spring 71 is hung on a stud 72 projecting from the frame panel 50. Owing to this arrangement, a tensile force of the coiled spring 71 is constantly exerted on the cylinder 69, whereby the position of the cylinder 69 is fixed to permit the bearing 63*b* to be substantially fixed.

When the cylinder 69 is turned by using the wrench 70 after the screw 73 has been loosened, the portion, which is other than the projecting portion 69*a*, of the cylinder 69 moves slightly since the projecting portion 69*a* is made eccentric with respect to the other portion of the cylinder 69. Consequently, the length of the coiled spring 71 varies to cause the tensile force exerted on the cylinder 69 to vary. Accordingly, the position of the bearing 63*b* is changed, while the tension applied by the end portion on the side of the bearing 63*b* of the tension roll 63 to the intermediate transfer belt 31 is also changed. The second panel 64 is provided with an elongated hole 74 which allows the cylinder 69 to be moved therein.

After the screw 73 has thus been loosened, the tension roll 63 can be swung by turning the cylinder 69. The position of an end portion of the tension roll 63 and the level of the tension applied to the intermediate transfer belt 31 have been regulated by utilizing this operation, and the screw 73 is then tightened, whereby the bearing 63*b* is substantially fixed again. Therefore, the skew of the image formed on the sheet 32 can be reduced by regulating the position of an end portion of the tension roll 63, and thereby regulating the direction of movement of the lower portion of the intermediate transfer belt 31. Namely, the same effect as has been described with reference to FIGS. 11(A)–11(C) is attained. The regulation of the position of the tension roll 63 can be carried out by, for example, repeating trials and errors in the same manner as in the first mode of embodiment.

In the second mode of embodiment, the position of one end portion of the tension roll 63 is set regulatable but the position of one end portion of the backup roll 42 may be set regulatable.

3. Third mode of embodiment

Figure 16:
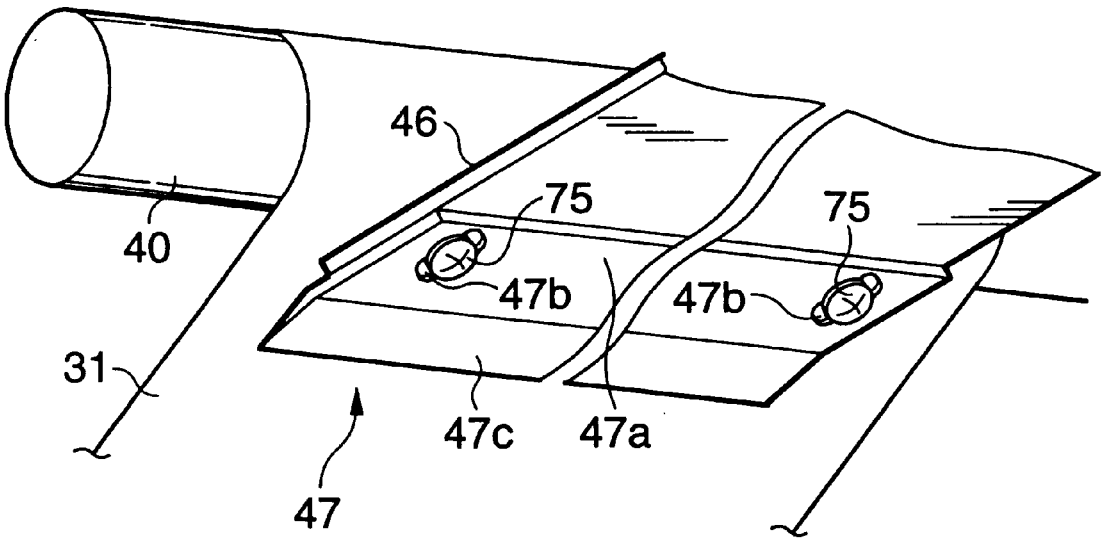
FIG. 16 is a perspective view showing a principal portion of the image forming apparatus of a third mode of embodiment of the present invention.

A third mode of embodiment of the present invention will now be described. The basic structure of the image forming apparatus of the third mode of embodiment is identical with that of the apparatus of FIG. 3 or 12. In the structure of the third mode of embodiment, the cleaning blades 47 of the cleaner 46 can be moved, and the positions of the cleaning blades 47 are fixed after they have been moved. As shown in FIG. 16, a base portion 47*a* of a cleaning blade 47 is provided with a plurality of elongated holes 47*b*, and the base portion 47*a* is fixed to a housing 46*a* of the cleaner 46 by screws 75 passed through these elongated holes 47*b*.

When the screws 75 are loosened to incline the cleaning blade 47 with respect to the intermediate transfer belt 31, the tension applied from a free end portion 47*c* of the cleaning blade 47 to the intermediate transfer belt 31 is rendered different at one end section of the cleaning blade 47 and at the other end section thereof. The screws 75 are then tightened again, and the cleaning blade 47 is fixed. The direction in which the lower portion of the intermediate transfer belt 31 moves can be regulated by these operations. This enables the skew of the image formed on a sheet 32 to be reduced. Namely, the effect identical with that described with reference to FIGS. 11(A)–11(C) is attained. The regulation of the position of the cleaning blade 47 can be carried out by, for example, repeating trials and errors in the same manner as in the first mode of embodiment.

4. Fourth mode of embodiment

A fourth mode of embodiment of the present invention will now be described. The basic structure of the fourth mode of embodiment is identical with that of the apparatus of FIG. 3 or FIG. 12. In the fourth mode of embodiment, the direction in which a lower portion of an intermediate transfer belt 31 moves is regulated by the techniques of either the first mode of embodiment or the third mode of embodiment or a combination thereof. This embodiment is further provided with a means of the type which is identical with the techniques enabling the position of the bearing 42*b* of the backup roll 42 or that of the bearing 63*b* of the tension roll 63 of the first mode of embodiment or the second mode of embodiment to be regulated, and which is capable of regulating the position of a bearing 40*b* of a driving roll 40. Therefore, not only the regulation of the direction in which a lower portion of an intermediate transfer belt 31 moves but also the regulation of the direction in which an upper portion thereof moves can be made. It is preferable that the bearing 40*b* be movable in the horizontal direction in FIG. 3 or FIG. 12, i.e., in the direction in which the upper portion of the intermediate transfer belt 31 moves.

Figure 17A:
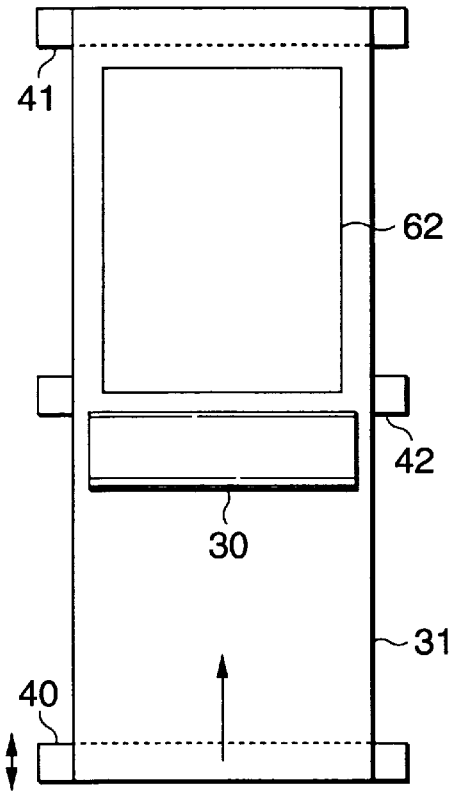
FIG. 17(A) is a plan view showing a belt in a fourth mode of embodiment of the present invention and a toner image transferred to an upper surface of the belt.
Figure 17B:
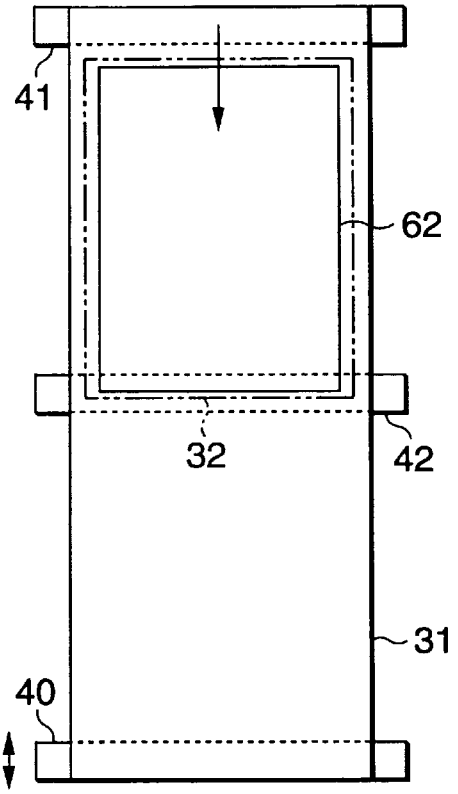
FIG. 17(B) is a bottom view of this image forming apparatus, showing a process for transferring the toner image, which has been transferred to the belt in this condition, to a sheet.

The effect of the fourth embodiment will now be described with reference to FIGS. 17(A) and 17(B). First, it is possible that the direction in which the upper portion of the intermediate transfer belt 31 be set substantially in agreement with that in which a photosensitive drum 30 is rotated, by regulating the position of an end portion of a driving roll 40 by swinging the same roll. Consequently, a toner image 62 having small skews of lead edge and side edges is transferred onto the intermediate transfer belt 31.

The direction in which the lower portion of the intermediate transfer belt 31 moves can be set substantially in agreement with that in which a sheet 32 moves. Accordingly, the skews of the lead edge and side edges of the toner image 62 transferred to the sheet 32 can be minimized.

5. Fifth mode of embodiment

A fifth mode of embodiment of the present invention will now be described. The basic structure of the image forming apparatus of the fifth mode of embodiment is identical with that of the embodiment shown in FIG. 3 or FIG. 12. In this structure, one bearing 30*c* supporting a shaft 30*a* of a photosensitive drum 30 is fixed in a predetermined position, while the other bearing 30*b* is rendered movable, the position of this bearing being fixed after it has been moved (refer to FIG. 18).

Figure 18:
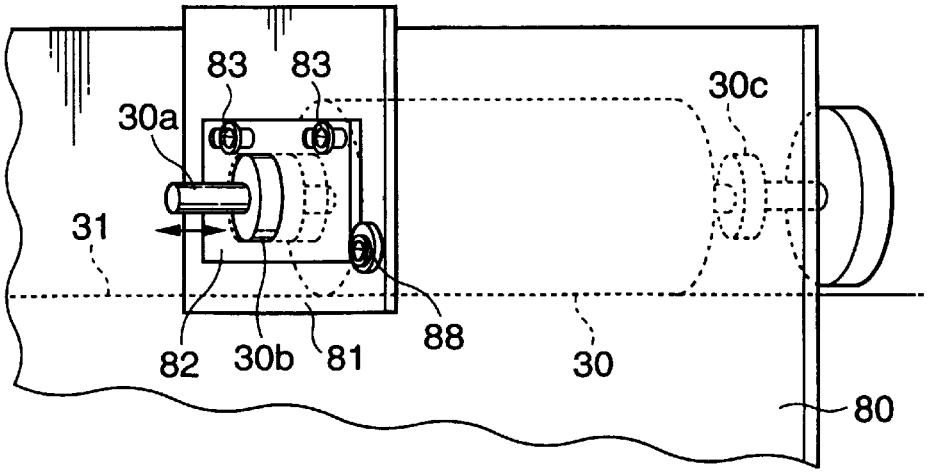
FIG. 18 is a perspective view showing a principal portion of the image forming apparatus of a fifth mode of embodiment of the present invention.
Figure 19:
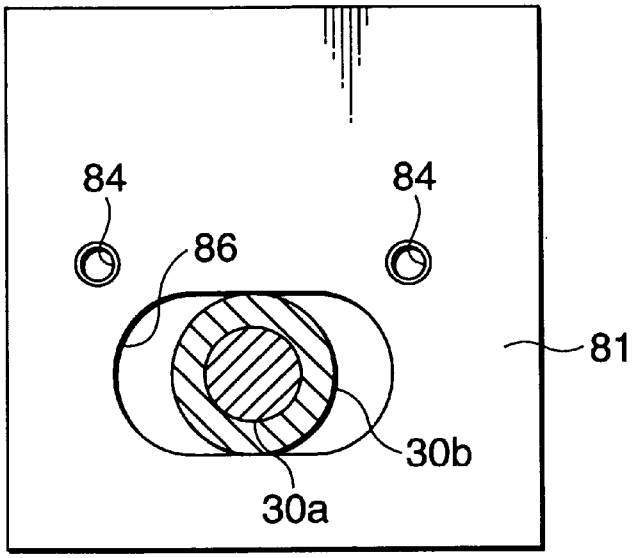
FIG. 19 is a front view showing a bracket used in the principal portion shown in FIG. 18.
Figure 20:
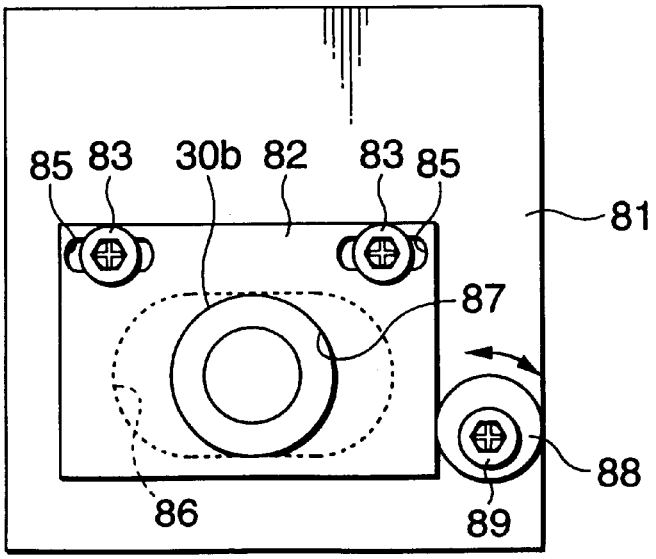
FIG. 20 is a front view showing the principal portion shown in FIG. 18.

FIGS. 18–20 show a concrete structure for regulating the position of the bearing. In FIG. 18, a reference numeral 80 denotes a frame panel on which the bearing 30*b* is supported. A flat plate type bracket 81 is fixed to the frame panel 80, and a second flat plate type bracket 82 to the bracket 81 by screws 83. As shown in FIG. 19, the bracket 81 is provided with threaded holes 84 with which the screws 83 are engaged, while, as shown in FIG. 20, the second bracket 82 is provided with laterally elongated through holes 85 through which the screws 83 are inserted. Therefore, when the screws 83 are loosened, the second bracket 82 can be slid laterally with respect to the bracket 81.

The bracket 81 is provided with a laterally elongated through hole 86 as shown in FIG. 19, while the second bracket 82 is provided a circular retaining through hole 87 as shown in FIG. 20. The bearing 30*b* of the photosensitive drum 30 is inserted into the elongated hole 86 and retaining hole 87. Since the diameter of the retaining hole 87 is substantially equal to an outer diameter of the bearing 30*b*, the bearing 30*b* can be moved laterally with the second bracket 82. A longer diameter of the elongated hole 86 is set larger than the outer diameter of the bearing 30*b* to allow the bearing 30*b* to move laterally.

A disc type eccentric cam 88 is fixed to the bracket 81 by a screw 89. Concretely speaking, the eccentric cam 88 is provided with a through hole the center of which deviates from that of the eccentric cam, and the screw 89 is inserted through this through hole and engaged with the bracket 81. Therefore, when the screw 89 is loosened, the eccentric cam 88 can be turned, and, due to this turning movement of the cam, the leftmost portion of a side surface thereof is displaced. This portion constitutes a basis of the position of the second bracket 82. Namely, the leftmost portion of the side surface of the eccentric cam 88 contacts a right side surface of the second bracket 82.

As described above, when the screw 83 is loosened, the bearing 30*b* can be moved with the second bracket 82 in the lateral direction, i.e., in the direction parallel to the upper portion of the intermediate transfer belt 31 which the photosensitive drum 30 contacts. Accordingly, the photosensitive drum 30 can be swung around the bearing 30*c* in a horizontal plane. The bearing 30*b* is then fixed by tightening the screws 83. Thus the skew of the image formed on a sheet 32 can be reduced by regulating the position of one end portion of the photosensitive drum 30. This effect will now be described with reference to FIGS. 21(A)–21(C).

A charging corotron 33, a latent image writing unit 34, a mirror 35, a developing unit 36 and a cleaner 38 disposed in circumference of a photosensitive drum 30 are adapted to move in parallel with the photosensitive drum 30 in accordance with a swinging movement thereof. Therefore, even when the regulation of the photosensitive drum 30 is made, functional troubles of these constituent elements do not occur.

Figure 2A:
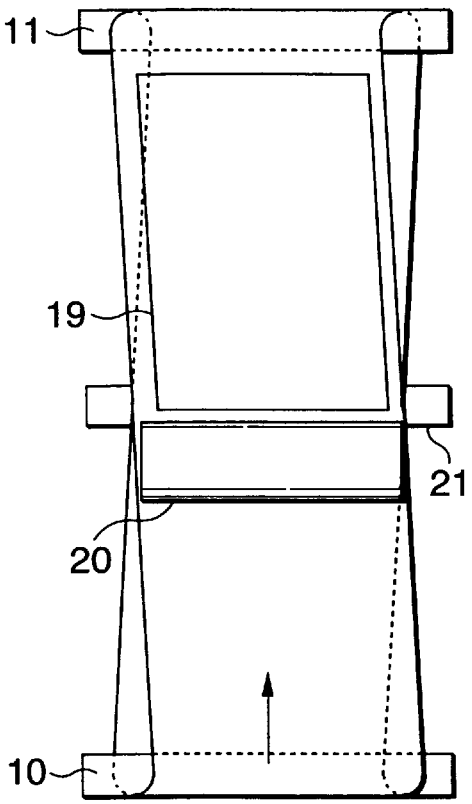
FIG.2(A) PRIOR ART
FIG. 2(A) is a plan view showing the condition of an endless intermediate transfer belt moving in an inclined state with respect to rolls in a conventional image forming apparatus adapted to transfer a toner image from photosensitive drums to the belt.
Figure 2B:
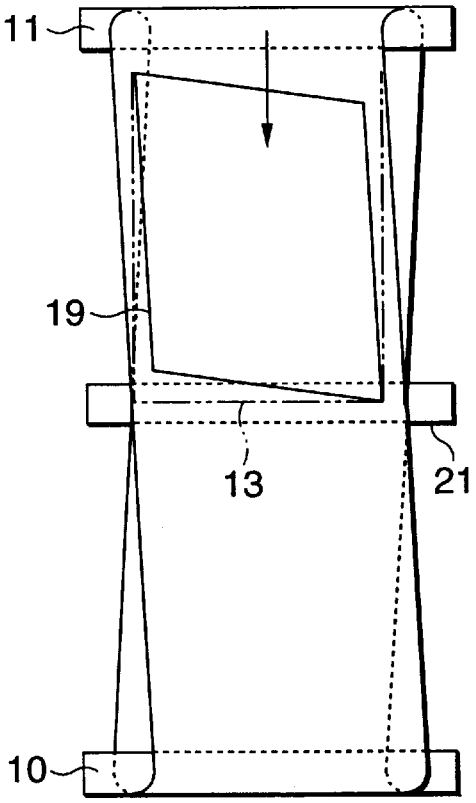
FIG.2(B) PRIOR ART
FIG. 2(B) is a bottom view of this image forming apparatus, showing a process for transferring the toner image, which has been transferred to the belt in the mentioned condition, to a sheet.
Figure 2C:
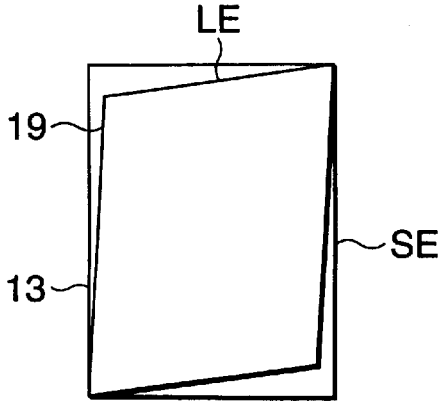
FIG.2(C) PRIOR ART
FIG. 2(C) is a plan view showing an image transferred to the sheet by this process.

The problems occurring in the conventional techniques when the belt moves incliningly with respect the rolls have been described with reference to FIGS. 2(A)–2(C). It is possible that the skews of a lead edge LE and side edges SE with respect to a sheet become noticeable. The main cause of the occurrence of the skew of the lead edge LE resides in the rotational movement of a distorted belt around the rolls, and the skew of the lead edge becomes small as shown in FIG. 2(A) immediately after a toner image has been transferred from the photosensitive drum onto the rolls.

Figure 21A:
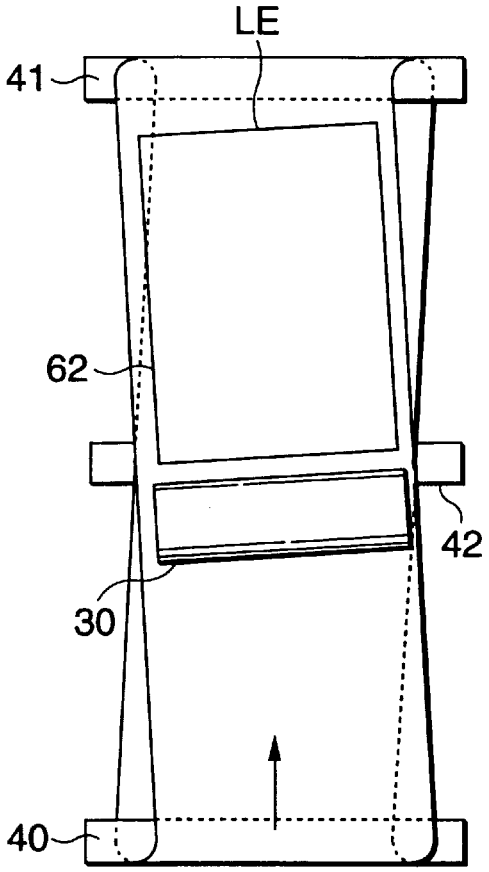
FIG. 21(A) is a plan view showing a belt in the fifth mode of embodiment and a toner image transferred to an upper surface thereof.
Figure 21B:
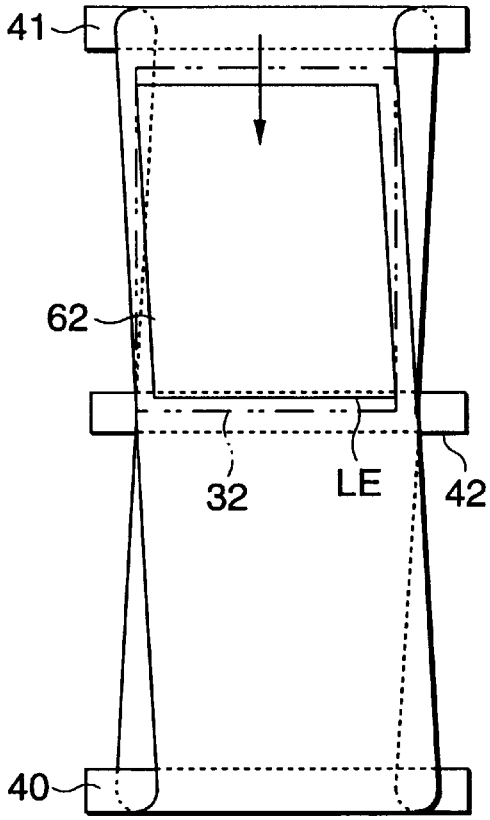
FIG. 21(B) is a bottom view of this image forming apparatus, showing a process for transferring the toner image, which has been transferred to the belt in this condition, to a sheet.
Figure 21C:
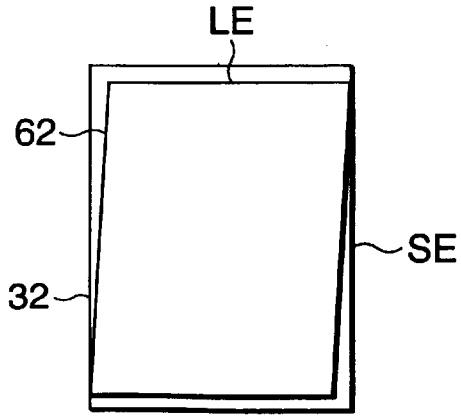
FIG. 21(C) is a plan view showing the image transferred to the sheet by this process.

Therefore, as shown in FIGS. 21(A) and 21(B), the lead edge LE of a toner image 62 may be inclined on the upper portion of the intermediate transfer belt 31 so that the lead edge of the toner image 62 becomes parallel to that of the sheet 32 onto which the toner image 62 is transferred on the lower portion of the intermediate transfer belt 31. In order to attain the inclination of the lead edge, the photosensitive drum 30 may be inclined with respect to the upper portion of the intermediate transfer belt 31 by swinging the photosensitive drum 30 in parallel with the upper portion of the intermediate transfer belt 31. Namely, even when the lead edge LE of the toner image 62 is skewed on the upper portion of the intermediate transfer belt 31, the skews of the side edges thereof become minimum as long as the lead edge LE is not skewed on the lower portion thereof with respect to the sheet 32. As a result, the skew of the lead edge of the toner image 62 formed on the sheet 32 is reduced as shown in FIG. 21(C).

The regulation of the photosensitive drum 30 can be made by, for example, repeating trials and errors. When the skew of the lead edge of the image practically formed on the sheet 32 is large, the screws 83 are loosened, and the position of the bearing 30*b* is regulated. The screws 83 are tightened again, and the forming of an image is done, the skew of the lead edge of the image formed on the sheet 32 being examined. When the skew of the lead edge has become minimum, the image forming apparatus is practically used. Such a regulating operation can be carried out prior to the shipping of the image forming apparatus or after the apparatus has been subjected to repair work including the replacement of the intermediate transfer belt 31.

The skew of the side edges SE cannot be eliminated by merely regulating the inclination of the photosensitive drum 30. The elimination of the skew of the side edges can be attained in the above-described first to third modes of embodiment. Accordingly, both the skew of the lead edge and that of the side edges can be reduced by the techniques of any one of the first to third modes of embodiment, or by a combination thereof. First, the regulation of the direction in which the lower portion of the intermediate transfer belt 31 moves is made by regulating the backup roll 42 (or tension roll 63 or cleaning blades 47) by the techniques of any one of the first to third modes of embodiment, to thereby enable the skew of the side edges to be minimized. The skew of the side edges may also be reduced by changing the direction of movement of the sheet by regulating the registration rolls 44, 45 instead of using the techniques of the first to third modes of embodiment. It is possible to minimize the skew of the lead edge by regulating the inclination of the photosensitive drum 30 in accordance with the techniques of the fifth mode of embodiment in addition to the above-mentioned techniques.

6. Sixth mode of embodiment

In order to obtain the toner image 62 of FIGS. 21(A)–21(B) as in the fifth mode of embodiment, not only the techniques for regulating the position of one end portion of the photosensitive drum 30 but also the following method may be used. For example, a method may be used, of supporting a latent image writing unit 34 for writing a latent image on the photosensitive drum 30, or a mirror 35 (refer to FIG. 3 or FIG. 12) so that it can be inclined, and fixing the latent image writing unit 34 or the mirror 35 after the angle of inclination thereof has been regulated. In this case, the techniques of any one of the first to third modes of embodiment, the techniques for regulating the registration rolls 44, 45, or a combination thereof, which are described in relation with the fifth mode of embodiment, may be used in combination with the techniques mentioned above. Namely, the skew of the lead edge may be minimized by inclining the latent image writing unit 34 or the mirror 35, and the skew of the side edges by using the techniques of any one of the first to third modes of embodiment, the techniques for regulating the registration rolls 44, 45, or a combination thereof.

Also, the image which the latent image writing unit 34 writes on the photosensitive drum 30 may be inclined by subjecting the image writing data, to which the latent image writing unit 34 refers when the latent image is written, to arithmetic processing. In this case, both the skew of the lead edge and skews of the side edges can be regulated by regulating both the main and auxiliary image scanning directions.

7. Seventh mode of embodiment

Figure 22:
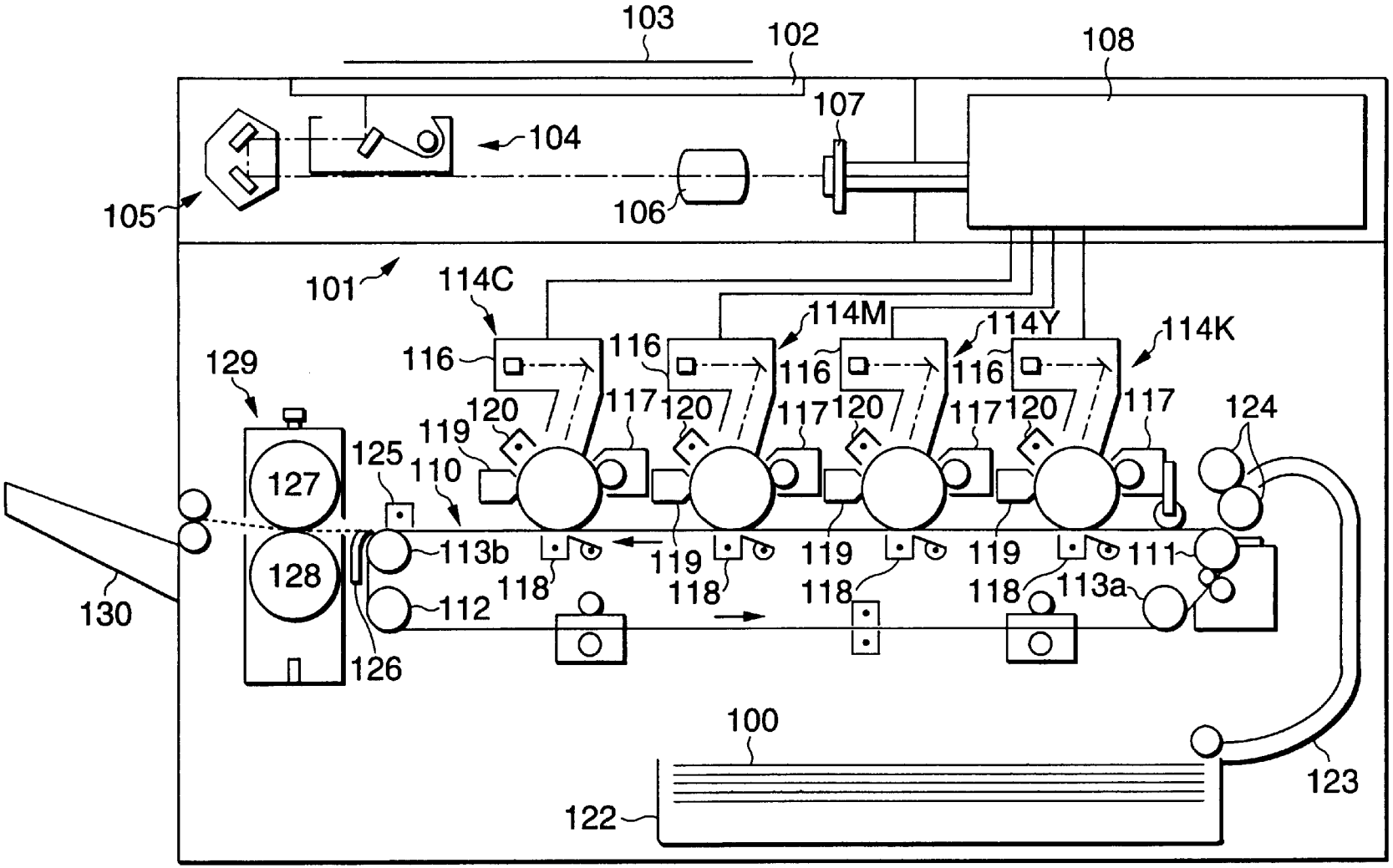
FIG. 22 is a drawing showing a general construction of the image forming apparatus of a seventh mode of embodiment of the present invention.

FIG. 22 is a schematic diagram showing the image forming apparatus of the seventh mode of embodiment. This image forming apparatus is a tandem type full color copier. As shown in the drawing, platen glass 102 as an original board is fixed to an upper portion of a reading unit 101 of the color copier, and an original 103 is placed on this platen glass 102. The reading unit 101 is provided with a full rate carriage 104, a half rate carriage 105, a lens 106 and a line sensor 107. As is well known, the light is applied to the original 103 during the travel of the carriages 104, 105, and the reflected light passes through the lens 106 to form an image on the line sensor 107. A read signal from the line sensor 107 is sent to an image processor 108, in which image writing data of black (K), yellow (Y), magenta (M) and cyan (C) are generated based on the read signal.

This copier is provided with a transfer belt 110, an endless belt for transferring a sheet 100 on which an image is formed. The transfer belt 110 is passed around a driving roll 111, a tension roll 112 and idler rolls 113*a*, 113*b* so that it can be rotated counter-clockwise in the drawing as shown by arrows along a laterally elongated substantially rectangular orbit. The transfer belt 110 moves around these rolls as it is driven by the driving roll 111 with a tensile force applied by the tension roll 112.

Figure 23:
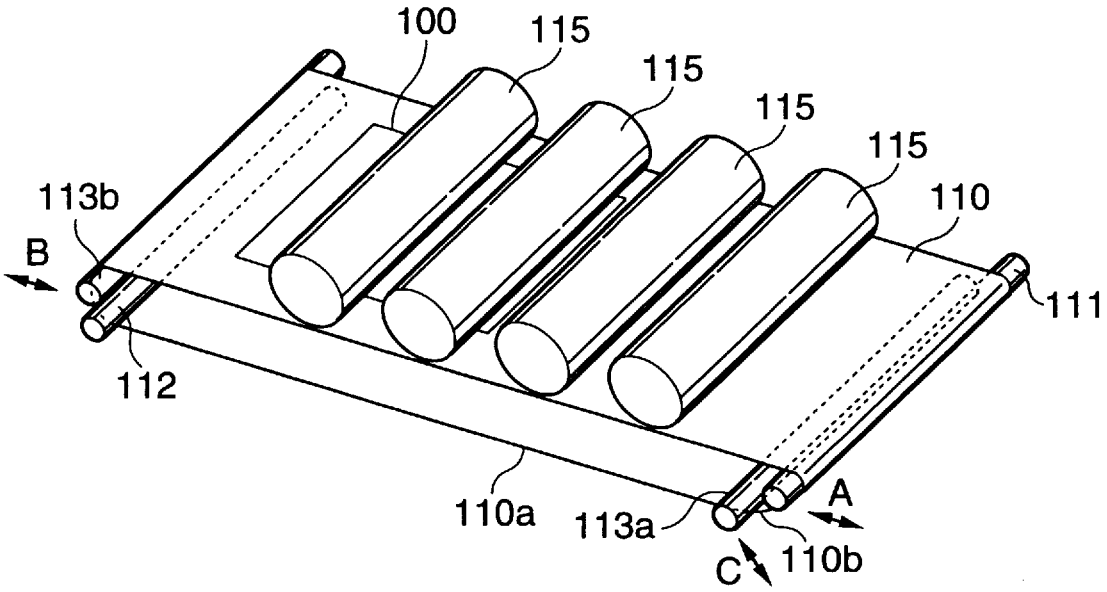
FIG. 23 is a perspective view showing a principal portion of the image forming apparatus of the seventh mode of embodiment of the present invention.

A sheet 100 sent out from a cassette 122 and passed through a chute 123 is fed onto the transfer belt 110. The sheet 100 passes between rolls 124 provided at an outlet of the chute 123, and then sucked to an upper surface of an upper portion of the transfer belt 110 owing to the effect of suction corotron (not shown). After the sheet 100 has been sucked to the transfer belt 110, it moves in accordance with a movement of the belt 110 as shown in FIG. 23.

In the vicinity of the upper portion of the transfer belt 110, four image forming units 114K, 114Y, 114M, 114C are arranged in a spaced manner. Each image forming unit is provided with a rotatable photosensitive drum 115, a latent image writing means 116, a developing means 117, a transfer corotron 118, a cleaner 119 and a charging corotron 120. While the photosensitive drum 115 is rotated, the charging corotron 120 uniformly charges the surface thereof, and the charged surface is irradiated with a laser beam sent out from the latent image writing means 116. Consequently, a latent image is formed owing to a photoelectric effect. The developing means 117 is adapted to supply charged toner onto the surface of the rotatable photosensitive drum 115. The toner is adsorbed on the latent image portion to form a toner image. The toner image formed on the surface of the photosensitive drum 115 is transferred to the sheet 100 on the transfer belt 110 owing to an electric field generated by the transfer corotron 118. After this transfer operation has been completed, the photosensitive drum 115 is cleaned by the cleaner 119.

The image forming units 114K, 114Y, 114M, 114C are adapted to form toner images of four colors, K, Y, M, C on the sheet 100. Namely, image writing data of any one of K, Y, M, C are supplied from the image processor 108 to the latent image writing means 116 of each unit, and the latent image writing means 116 forms a latent image on the corresponding photosensitive drum 115 on the basis of the corresponding image writing data. The developing means 117 of each unit supplies toner of any one of K, Y, M, C to the corresponding photosensitive drum 115. Accordingly, toner images of four colors are laminated on the sheet 100.

The sheet 100 to which a multi-color toner image has thus been transferred is carried in accordance with the movement of the transfer belt 110 to reach a charge removing corotron 125, by which the attractive force thereof with respect to the transfer belt 110 is weakened, and the sheet is separated from the transfer belt 110 by a peeling claw 126. While the sheet 100 is passed between a heating roll 127 and a pressure roll 128 of a fixing unit 129, the toner is fixed to the sheet 100. The toner which receives heat and pressure between these rolls 127, 128 is fused to the sheet 100, and forms various colors. The sheet 100 which has passed through the fixing unit 129 is discharged to a discharge tray 130.

Figure 1A:
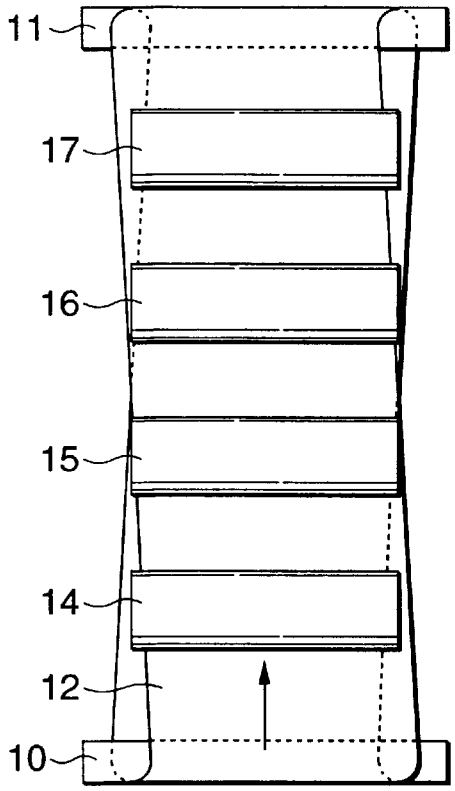
FIG.1(A) PRIOR ART
FIG. 1(A) is a plan view showing the condition of an endless belt moving in an inclined state with respect to rolls in a conventional image forming apparatus having photosensitive drums arranged in tandem with respect to the belt.
Figure 1B:
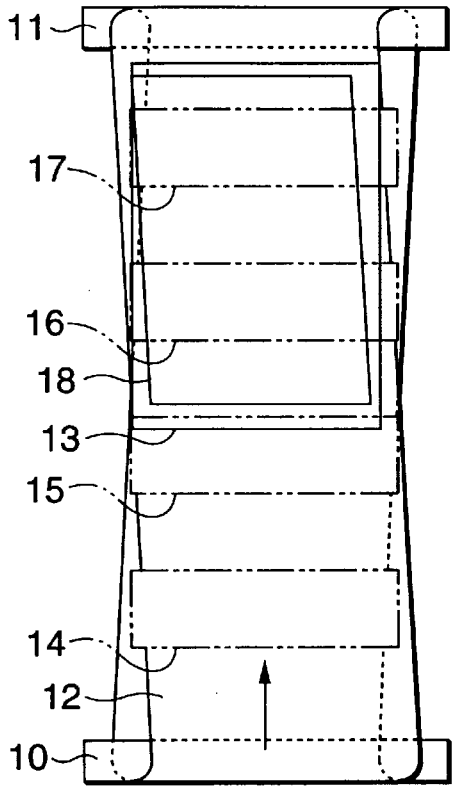
FIG.1(B) PRIOR ART
FIG. 1(B) is a plan view of the above image forming apparatus, showing a process for transferring a toner image to a sheet fixed to the belt in the mentioned condition.
Figure 1C:
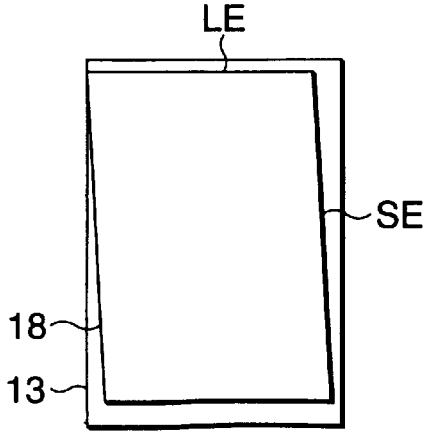
FIG.1(C) PRIOR ART
FIG. 1(C) is a plan view of an image transferred to the sheet by this process.

As described above with reference to FIGS. 1(A)–1(C), the skew of side edges SE of the resultant toner image becomes large in some cases in this type of image forming apparatus even when the skew of a lead edge LE thereof is small. In order to reduce the skew of side edges, any one of the following techniques or a combination thereof is effectively used.

The position of one end portion of the driving roll 111 may be set movable. In this case, a suitable roll end-moving direction is a lateral direction parallel to the axis of the upper portion of the transfer belt 110 as shown by an arrow A in FIG. 23.

The position of one end portion of the idler roller 113*b* may be set movable. In this case, a suitable roll end-moving direction is a lateral direction parallel to the axis of the upper portion of the transfer belt 110 as shown by an arrow B in FIG. 23.

The position of one end portion of the idler roll 113*a* may be set movable as shown by arrow C in FIG. 23. In this case, a suitable roll end-moving direction is a direction along a bisector of an angle made by two sides 110*a*, 110*b*, between which the idler roll 113*a* is held, of the transfer belt 110 or the intermediate transfer belt 31.

Figure 24:
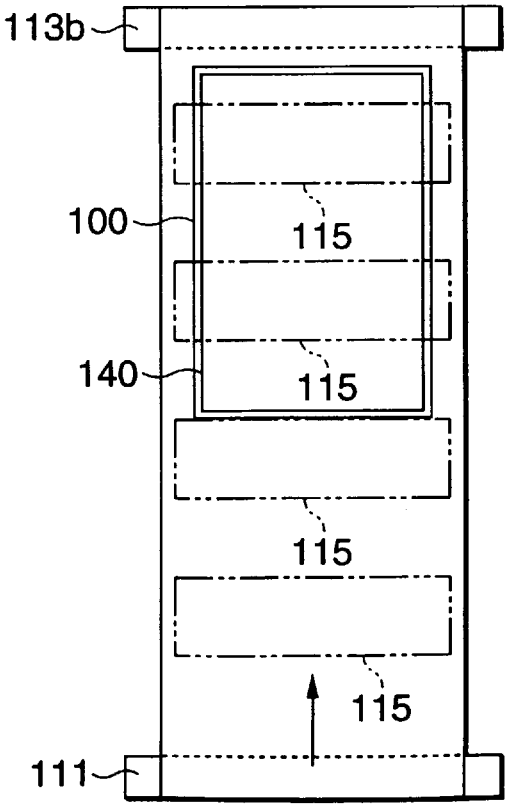
FIG. 24 is a plan view showing a belt in the seventh mode of embodiment and a toner image transferred to a sheet on this belt.

When the direction of movement of the upper portion of the transfer belt 110 to which the toner images from the image forming units 114K, 114Y, 114M, 114C are transferred is thus regulated, it can be aligned with the direction in which the photosensitive drum 115 rotates. After the regulation of the position of the roll end portion has been made, the position is fixed. The concrete techniques for making this regulation are identical with those used in the first and second modes of embodiment, i.e. the techniques for rendering movable the position of one roll-supporting bearing. When the direction of movement of the transfer belt 110 has agreed with that of rotation of the photosensitive drum 115, a toner image 140 the skew of side edges of which has been minimized is transferred to the sheet 100 on the transfer belt 110 as shown in FIG. 24. Such a regulating operation can be carried out prior to the shipping of the image forming apparatus or after the apparatus has been subjected to repair work including the replacement of the intermediate transfer belt 31.

Also, the image which the latent image writing unit 116 writes on the photosensitive drum 115 may be inclined by subjecting the image writing data, to which the latent image writing unit 116 refers when the latent image is written, to arithmetic processing. In this case, the image scanning direction may be regulated so as to regulate the skew of side edges. This regulating operation can also be carried out prior to the shipping of the image forming apparatus or after the image forming apparatus has been subjected to repair work including the replacement of the intermediate transfer belt 31.

Concerning the tension roll 112, the techniques disclosed in Japanese Patent Laid-Open No. 110229/1997 may be applied. This can prevent the transfer belt 110 in motion from moving laterally (axial direction of the tension roll 112) by not less than a predetermined distance.

According to the present invention described above, the skew of an image formed on a sheet can be reduced.

What is claimed is:

1. An image forming apparatus comprising:

a plurality of rotatable rolls;

an endless belt passed and moving around said rolls;

a means for forming an image on said endless belt or a sheet placed on said endless belt;

a contacting member adapted to contact said endless belt in the widthwise direction thereof, and having two end portions the position of at least one of which can be regulated; and a means for fixing the position of said contacting member after the position thereof has been regulated.

2. The image forming apparatus according to claim 1, wherein said contacting member is at least one of said rolls.

3. The image forming apparatus according to claim 1, wherein said contacting member is a cleaning blade.

4. An image forming apparatus comprising:

a plurality of rotatable rolls;

an endless belt passed and moving around said rolls; and a means for forming an image on said endless belt or a sheet placed on said endless belt, wherein a position of at least one portion in the widthwise direction of said image on said endless belt of said image forming means is regulatable by regulating a position of at least one end portion of a photo-sensitive drum.

* * * * *